US006647692B1

(12) United States Patent
Röder

(10) Patent No.: US 6,647,692 B1
(45) Date of Patent: Nov. 18, 2003

(54) SUPPORT AND CONNECTING PROFILE

(75) Inventor: Heinz Röder, Büdingen (DE)

(73) Assignee: Thuringer Bauholding GmbH, Budingen (DE)

( * ) Notice: Subject to any disclaimer, the term of this patent is extended or adjusted under 35 U.S.C. 154(b) by 0 days.

(21) Appl. No.: 09/857,639

(22) PCT Filed: Oct. 17, 2000

(86) PCT No.: PCT/EP00/10191

§ 371 (c)(1),
(2), (4) Date: Jun. 7, 2001

(87) PCT Pub. No.: WO01/46536

PCT Pub. Date: Jun. 28, 2001

(30) Foreign Application Priority Data

Dec. 22, 1999 (DE) ..... 299 22 559 U

(51) Int. Cl.[7] ..... E04C 3/30

(52) U.S. Cl. ..... 52/730.4; 52/731.2; 52/732.1; 52/731.4; 52/737.6; 428/36.9

(58) Field of Search ..... 52/317, 2.25, 82, 52/222, 730.4, 731.2, 732.1, 731.4, 731.5, 732.3, 737.6; 135/123, 87; 428/36.9, 36.91, 39.91; 122/511

(56) References Cited

U.S. PATENT DOCUMENTS 3,972,529 A 8/1976 McNeil
5,226,373 A * 7/1993 Esch ..... 52/DIG. 9
5,617,685 A * 4/1997 Meier et al. ..... 52/737.4
5,921,053 A * 7/1999 Callahan et al. ..... 52/731.2
6,007,894 A * 12/1999 Barnes et al. ..... 428/120
6,339,909 B1 * 1/2002 Brunnhofer et al. ..... 52/786.13
6,345,638 B1 * 2/2002 Warner ..... 52/63

FOREIGN PATENT DOCUMENTS

| | | |
|---|---|---|
| DE | 30 17 336 | 11/1981 |
| DE | 34 13 069 | 10/1985 |
| EP | 0 211 096 | 2/1987 |
| GB | 2 282 096 | 3/1995 |
| WO | 93/15293 | 8/1993 |
| WO | 96/38209 | 12/1996 |

* cited by examiner

*Primary Examiner*—Carl D. Friedman
*Assistant Examiner*—Nahid Amiri
(74) *Attorney, Agent, or Firm*—Wenderoth, Lind & Ponack, L.L.P.

(57) ABSTRACT

The invention relates to a support and a connecting profile made of plastic, synthetic resin, phenol and/or light metal for a self-regulating skeleton, in particular for halls constructed from light materials and large tent constructions, characterized in that the profile body (5) is provided with reinforcements (4,8) on or introduced in certain areas and which are made of fiber composite materials, e.g. glass, carbon or aramide fibers.

20 Claims, 1 Drawing Sheet

SUPPORT AND CONNECTING PROFILE

BACKGROUND OF THE INVENTION

1. Field of the Invention

The invention relates to a support and connecting profile comprised of synthetic material, synthetic resin, phenol and/or light metal for a self-supporting framework, and in particular, for light construction of hangars and large tent structures.

2. Description of the Related Art

Profiles are used for bearing and supporting structures, and in particular for small tents. Apart from structures in which the profiles are erected together with a tent skin to secure the profiles in position, self-supporting frameworks over which is pulled a roof skin are also known. In WO 93/15293, a portable tent system is described with an envelope shielded against radio frequencies, whose frame forms a self-supporting framework of fiberglass poles.

For large tents employed outside or for light construction hangars, in contrast, most often steel or aluminum profiles are used for constructing a self-supporting framework in order to absorb the greater forces occurring in large structures. In particular steel, but also aluminum, profiles with satisfactory strength have a comparatively heavy weight which makes the erection and disassembly of large tent structures, as well as their transport, difficult.

DE 34 13 069 C2 discloses support poles comprising fiberglass-reinforced synthetic material, which can be used inter alia for large capacity tents and skeleton-like structures. For this purpose, the support poles, for example, are completely pervaded by a fiberglass fabric, fiberglass spun threads, or fiberglass rovings extending through the profile in the axial and radial directions, that are used as reinforcement elements. The support profile also comprises additional statistically distributed fiberglass segments. With them, support profiles are intended to be formed which have high loading capacity in the axial direction, as well as in the radial direction.

SUMMARY OF THE INVENTION

The task of the present invention is to provide a support and connecting profile of the above described type for framework structures, which is especially adapted to its function and is rugged and not subject to damage even at low weight and under high loading.

This task is solved with the present invention in that the profile body or in specific regions thereof comprises reinforcements of a fiber composite, for example, glass, carbon or aramid fibers, applied onto or introduced into the profile body.

By means of the reinforcements purposefully integrated into the profile body, regions, especially those subject to local loading, of the nevertheless extremely light profile, in the skeleton structure can be especially reinforced or adapted thereby to differing stresses without any change in cross section, while the remaining regions, for reasons of cost, can remain unreinforced. Depending on the function of the profile in the structure, different loadings occur. Apart from axial loads, essentially acting axially onto the perpendicular support profiles, connecting profiles also absorb, for example, shearing forces, in order to prevent a collapse of the skeleton. In particular, at the fastening and connecting sites of the profile, high forces occur. According to the present invention, these forces can be absorbed through special reinforcements, which are each adapted to the magnitude of the force acting upon it. Therefore, the present invention not only makes it possible to apply individual support poles of a light material, for example, fiberglass-reinforced synthetic material, in the erection of skeletons for light construction of hangars and big tents, but also to erect the self-supporting skeleton entirely, or at least largely, of synthetic material or light metal profiles, which, compared to solid metal profiles, are significantly lighter. In particular, synthetic material profiles are also more elastic than metal profiles such that relatively large impacts, for example, if individual parts are dropped during the assembly, do not lead to permanent deformations.

The reinforcements can be variably applied if they are developed as strips or the like, which can be fastened or introduced by adhesion, bolts or rivets on or in the profile body. The strips can be applied only on one: side of the profile body. Especially high flexural strength can be attained, however, if reinforcements, for example, in the form of strips, are applied on two opposing sides on either the inside or the outside of the profile body.

For simple positioning, the profile body can comprise recesses or indentations for receiving the reinforcements. These recesses or indentations additionally strengthen the profile body itself The profile bodies can be developed as hollow profiles of synthetic material or as hollow aluminum profiles.

The profile body comprising additionally defined reinforcements is preferably developed as a continuous glass or carbon fiber profile. In this implementation according to the invention, the unreinforced synthetic material profile already has a high degree of rigidity at low weight. In this case, the reinforcements can especially advantageously be woven into the glass or carbon fiber fabric of the profile body, whereby high spot reinforcements can also be attained.

To attain a high refractory quality of the profile, chemicals having low flammability can be added to the glass or carbon fiber profile body. In this way, the guidelines applying inter alia to the erection and operation of tents can be observed. The guidelines laid down for Germany require that all building materials according to DIN 4102 Part 1 must at least be flame-resistant. Only for roofing, which is higher than 2.30 m above pedestrian areas, is it normally allowed that inflammable building materials according to DIN 4102 Part 1 are used. In Europe, the US, Japan. and East Asia, no specific legislation exists for tents. The tents are to some extent treated like other structural installations, i.e., they are also subject to the fire protection provisions for such structural installations. These require to some extent that the buildings must be able to withstand fire for 30 or 60 minutes. Aluminum and steel alone cannot achieve this; rather, they become deformed or they begin to melt. For the addition of corresponding chemicals, such as aluminum trihydrate, bromine or the like, to the synthetic resin, such as phenol, in the case of glass or carbon fiber structures, every fire classification can be attained such that every national requirement can be met.

The reinforcements can be introduced especially simply in a synthetic profile body produced by pultrusion. Even the reinforcements comprised of fiber composite materials can be produced simply by pultrusion. In a further development of the invention, the profile body is dyed throughout. In this way, color fastness is not impaired by scratches and slight damage to the profile body.

According to the invention, the profile body can be developed as a post, roof girder, gable support, gable cross transverse, roof beam, cloth holder, post shoe, gable support with bottom securement, strut girder connection in the gutter region, roof ridge connection between individual roofgirders, connecting part between gable supports and roof girders, cross bracing for rigidification between posts and between roof girders or the like framework parts. In this way, the self-supporting skeleton can be constructed entirely of synthetic profiles of the type according to the invention.

Further characteristics, advantages and application feasibilities of the invention are evident in the following description of embodiment examples and the drawings. All described characteristics by themselves or in any combination form the subject matter of the invention independently of their recapitulation in the claims or their reference below.

DETAILED DESCRIPTION OF THE INVENTION

A support or connecting profile 1 for erecting a self-supporting skeleton for light construction hangars and large tents is a synthetic profile, for example, comprised of polyester, epoxy, acrylic or vinyl resin, which is reinforced by fiber composite materials, integrated into the resin molding material, such as glass, carbon or aramid. These synthetic profiles are employed for posts, standing perpendicular on the ground, as well as for roof structures, for example, a gable roof, which rests on the perpendicular posts. Between the posts, as well as in the roof structure between the profiles bearing the load, connecting profiles for making the skeleton-like framework rigid are necessarily applied. These connecting profiles are also comprised of fiberglass-reinforced synthetic material. Since the specific weight of fiberglass is only approximately 30% of the specific weight of aluminum, the weight of the entire skeleton can be reduced considerably by using synthetic material profiles. This facilitates the transport and the erection of the skeleton for light construction hangars and large tents, whereby costs are reduced to a considerable extent, and leads to a decrease of the load resting on the support posts, whereby the construction of the skeleton is simplified.

However, shearing forces, for example, due to wind on the tent or the hangar, cause, at the connecting sites between the support and connecting profiles, forces to act obliquely onto the profiles. In order for the synthetic profile to be able to absorb these high forces, as well as others, at specific sites or regions of the skeleton structure, according to the invention, special reinforcements are introduced at these sites or regions into synthetic profile body 5. These are, for example, woven into the fiberglass fabric of the synthetic profile body 5. As a function of direction and magnitude of the forces exerted, these special reinforcements can be glass, carbon or aramid fibers or also synthetic wires.

To form the synthetic profile 1 with respect to color, coloring substances are added directly to the resin molding material, such that the synthetic profile body 5 is dyed completely throughout. In contrast to metal profiles which are only color coated or painted, scratches or slight damage do not lead to esthetic losses. Such synthetic profiles are therefore, also especially maintenance-friendly.

Figure 1:
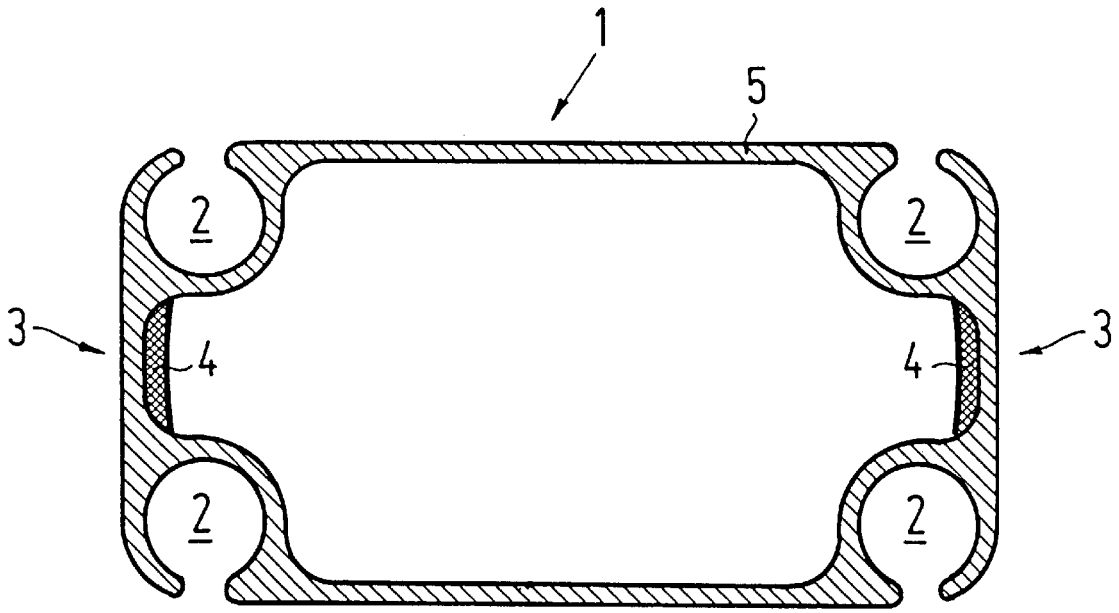
FIG. 1 is across section through a support and connecting profile according to the invention with reinforcements.

FIG. 1 shows in cross section the profile 1 developed as a hollow aluminum profile. The profile 1 is substantially rectangular and comprises at particular corners, circular grooves 2 opened toward the outside, in which, for example, fastening elements, not shown, can be applied. At opposing narrow sides 3 of the profile body 5 developed as a hollow profile, carbon fiber reinforcements 4 developed in the form of strips are applied by adhesion, bolts or rivets on the inside between two grooves 2.

Figure 2:
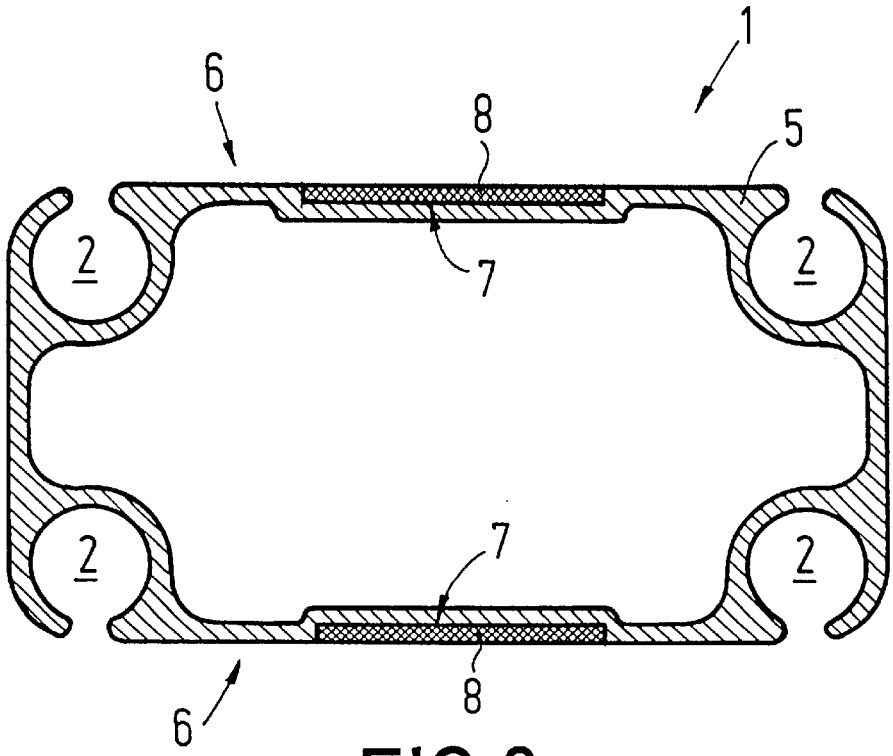
FIG. 2 is a cross section through a further implementation of a support and connecting profile according to the invention with reinforcements.

FIG. 2 shows a comparable profile body 5 which is also rectangular and comprises, at the four corners, corresponding grooves 2. In this profile body 5 in the center of broad sides 6, opposing flat recesses 7 are developed in which strip-like carbon fiber reinforcements 8 are received. Through the application or introduction of the carbon strips 4, 8 onto the hollow profile body 5, the hollow profile body's flexural rigidity can be substantially increased with an insignificant increase of the weight. Therein, the profile body 5 developed as a hollow profile forms the basic profile. The profile body 5 is reinforced such that at the inside and/or outside on two opposing sides 3 or 6, reinforcements 4, 8 are fastened in the recesses 7 as strips of, for example, pultruded carbon fibers by, for example, adhering, bolting or riveting them on. A weight advantage can be attained such that when using a relatively thin (lighter) aluminum profile in connection with the reinforcement of carbon fibers, greater values for tensile strength, compressive strength, modulus of elasticity and flexural rigidity can be attained.

In a typical extruded aluminum profile with dimensions of 130×70 mm and a wall thickness of 3 mm, the rigidity is increased from approximately 70 Npa to 120 Npa by installing two strips with the dimensions of 80×1.2 mm at the opposing sides of the profile body 5. An extruded aluminum profile with a weight of approximately 4 kg per meter run yields approximately the same technical values as a thicker aluminum profile having a weight of approximately 6 kg per meter run.

With profiles specifically reinforced at sites or regions especially subject to loading, it is consequently possible to erect in a simple manner, self-supporting skeletons in particular for light construction hangars and large tent structures, which, at high bearing capacity, have low true specific weight due to the comparatively light aluminum or synthetic profiles.

What is claimed is:

1. A support and connecting profile for a self-supporting framework of a light construction hanger or a large tent structure, said support and connecting profile comprising:

a profile body made of one of a glass fiber fabric and a carbon fiber fabric and at least one chemical operable to increase a refractory quality of said profile body; and at least one reinforcement made of a fiber composite material included within at least one region of said profile body.

2. A support and connecting profile according to claim 1, wherein said fiber composite material of said at least one reinforcement is one of glass fibers, carbon fibers, and aramide fibers.

3. A support and connecting profile according to claim 1, wherein said at least one reinforcement is woven into said at least one region of said profile body.

4. A support and connecting profile according to claim 1, wherein said chemical is one of aluminum trihydrate and bromine.

5. A support and connecting profile according to claim 1, wherein said at least one of said profile body and said at least one reinforcement is produced by pultrusion.

6. A support and connecting profile according to claim 1, wherein said profile is dyed throughout.

7. A support and connecting profile according to claim 1, wherein said profile body is one of a post, a roof girder, a gable support, a gable cross transverse, a roof beam, a cloth holder, a post shoe, a gable support with bottom securement, a strut girder connection, a roof ridge connection between roof girders, a connecting part between gable supports and roof girders, and a cross bracing.

8. A support and connecting profile comprising:

a profile body having a rectangular shape and a circular groove located at each corner region of said rectangular shape, each of said circular grooves being adapted to receive a fastening element, wherein each of at least two opposing sides of said profile body have a hollow profile adapted to receive a reinforcing member; and at least one reinforcing member located in one of said at least two hollow profiles.

9. A support and connecting profile according to claim 8, wherein two sides of said profile body have flat recesses formed therein, wherein each of the flat recesses is adapted to receive a reinforcing member.

10. A support and connecting profile according to claim 8, wherein said at least one reinforcement is strip shaped and is fastened to said one of said at least two hollow profiles.

11. A support and connecting profile according to claim 8, wherein said at least one reinforcement is fastened to said one of said at least two hollow profiles with bolts.

12. A support and connecting profile according to claim 8, wherein said at least one reinforcement is fastened to said one of said at least two hollow profiles with rivets.

13. A support and connecting profile according to claim 8, wherein said at least one reinforcement is fastened to said one of said at least two hollow profiles with adhesive.

14. A support and connecting profile according to claim 8, further comprising an additional reinforcing member located in another of said at least two hollow profiles.

15. A support and connecting profile according to claims 8, wherein said profile body is made of one of hollow aluminum and synthetic material.

16. A support and connecting profile according to claim 8, wherein said profile body is made of one of fiberglass and carbon fiber.

17. A support and connecting profile comprising:

a profile body having a rectangular shape and a circular groove located at each corner region of said rectangular shape, each of said circular grooves being adapted to receive a fastening element, wherein each of at least two opposing sides of said profile body have a hollow profile adapted to receive a reinforcing member and each of at least two opposing sides of said profile body have a flat recess formed therein adapted to receive a reinforcing member; and at least one reinforcing member located in one of said at least two flat recesses.

18. A support and connecting profile according to claim 17, further comprising an additional reinforcing member located in another of said at least two flat recesses.

19. A support and connecting profile according to claim 17, wherein said at least two flat recesses are formed on an outer circumference of said profile body.

20. A support and connecting profile comprising:

a profile body having a rectangular shape and a circular groove located at each corner region of said rectangular shape, each of said circular grooves being adapted to receive a fastening element, wherein each of at least two opposing sides of said profile body have a hollow profile adapted to receive a reinforcing member and each of at least two opposing sides of said profile body have a flat recess formed therein adapted to receive a reinforcing member; and at least one reinforcing member located in one of said at least two flat recesses, wherein said at least two flat recesses are formed on an inner circumference of said profile body.

* * * * *